US007094085B2

(12) United States Patent
Bona et al.

(10) Patent No.: US 7,094,085 B2
(45) Date of Patent: Aug. 22, 2006

(54) ELECTRICAL SOCKET ADAPTER

(76) Inventors: Emanuela Bona, Via Lamarmora 38, I-10128, Turino (IT); Raffaella Bona, Via Lamarmora 38, I-10128, Turino (IT); Raffaele Bona, Via Lamarmora 38, I-10128, Turino (IT)

( * ) Notice: Subject to any disclaimer, the term of this patent is extended or adjusted under 35 U.S.C. 154(b) by 0 days.

(21) Appl. No.: 10/521,666

(22) PCT Filed: Jul. 4, 2003

(86) PCT No.: PCT/EP03/07193

§ 371 (c)(1),
(2), (4) Date: Jul. 11, 2005

(87) PCT Pub. No.: WO2004/010547

PCT Pub. Date: Jan. 29, 2004

(65) Prior Publication Data

US 2006/0148291 A1 Jul. 6, 2006

(30) Foreign Application Priority Data

Jul. 19, 2002 (EP) ..... 02016125

(51) Int. Cl.
*H01R 29/00* (2006.01)

(52) U.S. Cl. ..... 439/172; 439/106; 439/222

(58) Field of Classification Search ..... 439/172–174, 439/106, 222
See application file for complete search history.

(56) References Cited

U.S. PATENT DOCUMENTS

| | | | | |
|---|---|---|---|---|
| 4,626,052 | A * | 12/1986 | Rumble | 439/173 |
| 6,126,460 | A * | 10/2000 | Wu | 439/131 |
| 6,328,581 | B1 | 12/2001 | Lee et al. | 439/106 |
| 6,520,787 | B1 | 2/2003 | Lott | 439/218 |
| 2003/0228778 | A1 * | 12/2003 | Shang | 439/172 |

FOREIGN PATENT DOCUMENTS

| | | |
|---|---|---|
| DE | 19835161 | 10/1999 |
| EP | 0477636 | 4/1992 |

* cited by examiner

*Primary Examiner*—Truc Nguyen
(74) *Attorney, Agent, or Firm*—Hooker & Habib, P.C.

(57) ABSTRACT

The present invention relates to an electrical socket adapter for selectively providing electrical pins and insertion holes in different configurations, the adapter comprising a casing with openings in a front side of the casing and at least one pin holder being removably placed in the casing, wherein the pin holder comprises electrical pins being extendable through corresponding openings in the casing to protrude from the casing. It is the object of the present invention to provide an electrical socket adapter applicable to a variety of electrical standards and being yet still compact and convenient. This object is solved by an electrical socket adapter of the above mentioned type characterized in that at least one electrical pin being hinged on the pin holder to be selectively extractable from the pin holder, wherein in an operative position the electrical pin protrudes from a front side of the pin holder, and in a rest position, the electrical pin is at least partially retracted in the pin holder.

14 Claims, 9 Drawing Sheets

ELECTRICAL SOCKET ADAPTER

The present invention relates to an electrical socket adapter for selectively providing electrical pins and insertion holes in different configurations, the adapter comprising a casing with openings in a front side of the casing, and at least one pin holder being removably placed in the casing, wherein the pin holder comprises electrical pins being extendable through corresponding openings in the casing to protrude from the casing.

U.S. Pat. No. 6,328,581 describes an electrical socket adapter of the above-mentioned type. The adapter comprises a variety of single, variously embodied plug members. Each plug member has a plurality of fixed metal prongs adapted for fastening to a certain standard electric socket. The plug members further comprise a plurality of coupling grooves around the periphery thereof to engage with coupling flanges radially inwardly disposed around a rear open side of a casing of the adapter. To fit different specifications subject to different electric codes of different countries, a respective large number of corresponding plug members has to be provided which makes handling and deposition of this adapter rather unwieldy.

It is the object of the present invention to provide an electrical socket adapter applicable to a variety of electrical standards and being yet still compact and convenient.

The object is solved with an electrical socket adapter of the above-mentioned type characterized in that at least one electrical pin being hinged on the pin holder to be selectively ejectable from the pin holder, therein in a operative position the electrical pin protrudes from a front side the pin holder, and in a rest position the electrical pin is at least partially retracted in the pin holder.

This adapter allows that, in the operative position, only this at least one electrical pin protrudes from the casing which has been selected by the operator whereas the non-selected electrical pins are stored at least partially in the pin holder in their rest position. To form another configuration, the operator has only to retract a non-used pin from its operative position to its rest position and to further select at least another pin to extract it from its rest position to its operative position. This way, a reservoir of pins necessary to form any plug can be formed in the pin holder in a space saving way resulting in a compact but nearly universal electrical socket adapter.

In an embodiment of the invention the at least one electrical pin is hinged by a ball-and-socket joint. The ball and socket joint provides a fulcrum around which the electrical pin can easily be brought at least into the operative position and the rest position.

According to another embodiment of the invention, the electrical pin has a mounting end with a bore hole engaging with a ball being provided between the bore hole and a hemispheric socket of the pin holder to allow a pivotal movement of the electrical pin from at least the rest position to the operative position and vice versa. By this construction, the electrical pin can be pivoted and can be guided at least to the operative position and the rest position.

According a further embodiment of the invention, the electrical pin has a spherical mounting end engaging with a hemispherical socket of the pin holder to allow a pivotal movement of the electrical pin at least from the rest position to the operative position and vice versa and/or to allow a rotating movement of the electrical pin around an axis parallel to its longitudinal axis. This makes it possible not only to bring the electrical pin to a certain rest position or a certain operative position but also to turn the electrical pin around its longitudinal axis to adjust a certain orientation of the cross-section of the electrical pin in at least these positions.

In a preferable embodiment of the invention, the at least one electrical pin is hinged on a shaft to allow a pivotal movement of the electrical pin perpendicular to a longitudinal axis of the shaft. This hinged joint provides a guided movement of the electrical pin around the shaft at least from the rest position to the operative position and vice versa. Optionally, this construction offers the possibility to hinge more than one pin on the shaft.

In a further preferable embodiment of the invention, the electrical pin has a mounting end with a bore hole through which the shaft is extended. This allows a stable rotary connection between the electrical pin and the shaft.

According to a favorable embodiment of the invention, the electrical pin has a mounting end with a springy arm provided to clutch the shaft in the rest position of the electrical pin and to clutch a spline at the front side of the pin holder in the operative position of the electrical pin. This construction permits a stable rotary connection between the electrical pin and the shaft during pivoting of the electrical pin from its rest position to a position in which the electrical pin can be removed from the shaft. It makes it further possible to remove the electrical pin from the shaft by expanding the springy arm. Then, the electrical pin can be secured by means of the springy arm on the spline at front side of the pin holder to be in its operative position. Further, the electrical pin can be removed from its operative position by expanding the springy arm from the spline and can be re-mounted on the shaft.

According to another favorable embodiment of the invention, the at least one pin holder comprises at least one ground pin holder and at least one phase pin holder. These pin holders can provide at least one ground pin and at least one phase pin, respectively. This makes it possible to retract or extract a pin of the ground pin holder independently from a pin from the phase pin holder and vice versa.

According to a further embodiment of the invention, one ground pin holder is sandwiched by two phase pin holders, wherein the ground pin holder is electrically insulated from the phase pin holder. With this constellation, plugs with different electrical pin configurations can be provided which are connectable with grounded and ungrounded sockets.

In a further embodiment of the invention, the ground pin holder has a plurality of ground pins and/or the phase pin holder has a plurality of phase pins. This offers the possibility to realize a nearly universal adapter which can be connected with various types of grounded or ungrounded sockets.

In yet another preferable embodiment of the invention, the adapter further comprises a pin insertion tool consisting of at least two metal cheeks with corresponding opposite recesses, wherein the metal cheeks are connected by at least one spring bringing the corresponding recesses together forming pin insertion holes. In the insertion holes, pins of a plug can be received to form an electrical connection between the plug and the pin insertion tool. The cheeks which are pressed together by the tension of the spring can hold closely a pin inserted in one of the insertion holes resulting in a good electrical contact between the pin and the pin insertion tool. On the other hand, by this device, the inserted pin is easy to unplug, from the pin insertion tool.

In yet a further embodiment of the invention, the casing comprises a first hollow shell and a second hollow shell, each being of an insulating material, wherein the first hollow shell being formed to house the at least one pin holder and the second hollow shell being formed to house at least one pin insertion tool, and wherein the shells are provided to be assembled such that an electrical connection between the pin holder and the pin insertion tool is formed, and to be disassembled such that the electrical connection is disconnected. The two shells facilitate a concentration of different kinds of electrical standards in one adapter device. A further advantage of this construction is that the at least one pin holder can be independently configured from the at least one pin insertion tool and vice versa.

According to a further embodiment of the invention, a fuse is placed between the at least one pin holder and at least one pin insertion tool, when an electrical connection between the pin holder and the pin insertion tool is formed. The fuse protects the adapter from electrical overloads.

In yet a further preferable embodiment of the invention, the casing comprises a plug guide being slidable on a second hollow shell formed to house at least one pin insertion tool to provide a reciprocating movement of the plug guide relative to the hollow shell along a longitudinal axis of the second hollow shell. With this construction a guidance can be formed to facilitate insertion and/or unplugging of a plug in the pin insertion tool.

The embodiments of the present invention will become more apparent from the following description with regard to the accompanying drawings in which FIG. 1 shows an embodiment of an adapter of the present invention;

Figure 1:
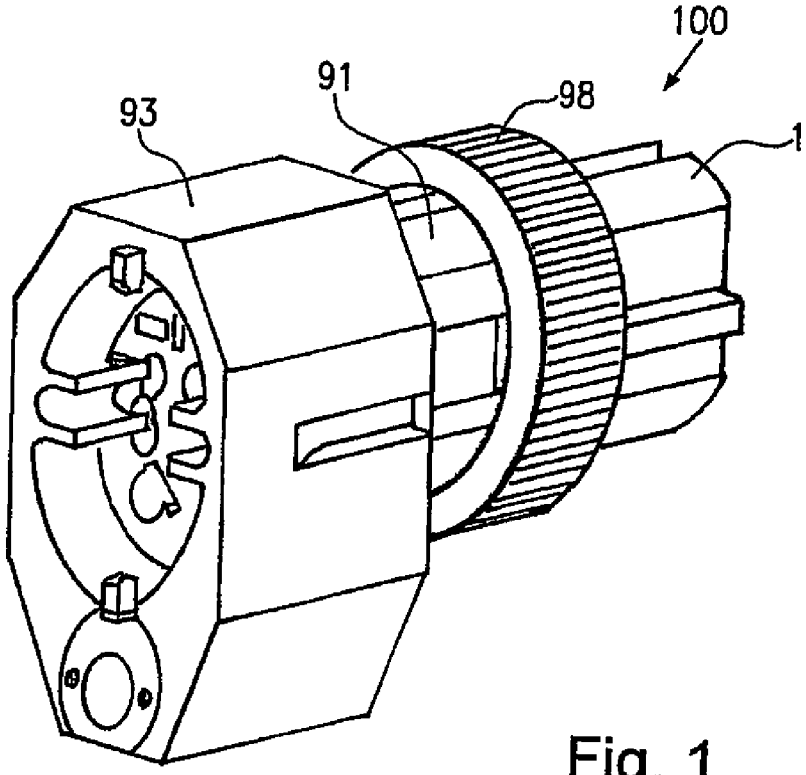
FIG. 1 shows an embodiment of an adapter 100 of the present invention. This adapter can accept nearly all plug standards while it can not include the Swiss outlet standard [L] as well as the Denmark outlet [E] ground pin.

The shown adapter 100 has a simple and compact octagonal shape with a round protruded body like the standard [F] used in the France and Germany. The adapter 100 has a casing which comprises a first hollow shell 1, a second hollow shell 91 and a plug guide 93, each being made of a plastic material. The first hollow shell 1 and the second hollow shell 91 are fastened together by means of a locknut 98. The plug guide 93 is slidably engaged with the second hollow shell 91 such that the plug guide 93 can perform a limited stroke sliding between two fixed positions along the longitudinal axis of the second hollow shell 91.

Figure 2:
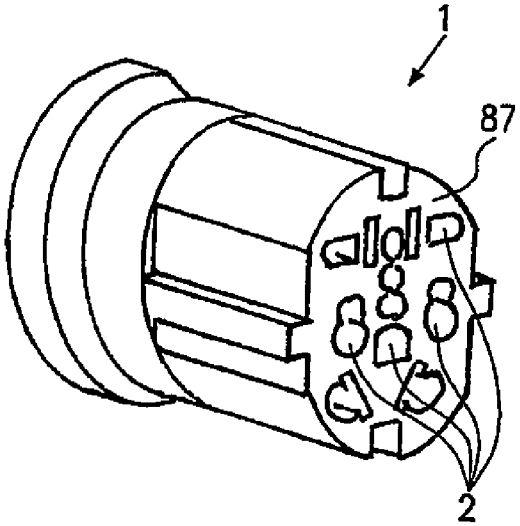
FIG. 2 is a perspective view of a first hollow shell of the adapter of FIG. 1 showing a front side of the first hollow shell.

FIG. 2 shows a perspective view of the first hollow shell 1 of FIG. 1 showing a front side 87 of the first hollow shell 1. The front side 87 of the first hollow shell 1 forms a face panel provided with a set of shaped openings 2. Through the openings 2 corresponding pins are extandable to form the requested plugs.

Figure 3:
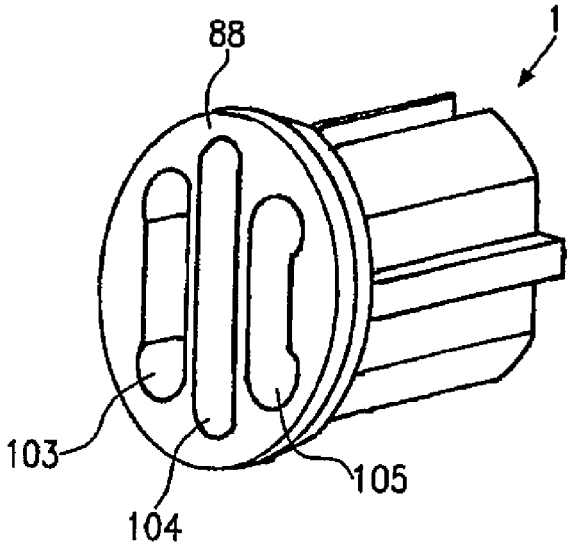
FIG. 3 is a perspective view of the first hollow shell of FIG. 2 showing a back side of the first hollow shell.

FIG. 3 shows the first hollow shell 1 shown in FIG. 2 from its back side 88. The back side forms a back panel containing three insulating rooms 103, 104, 105.

Figure 4:
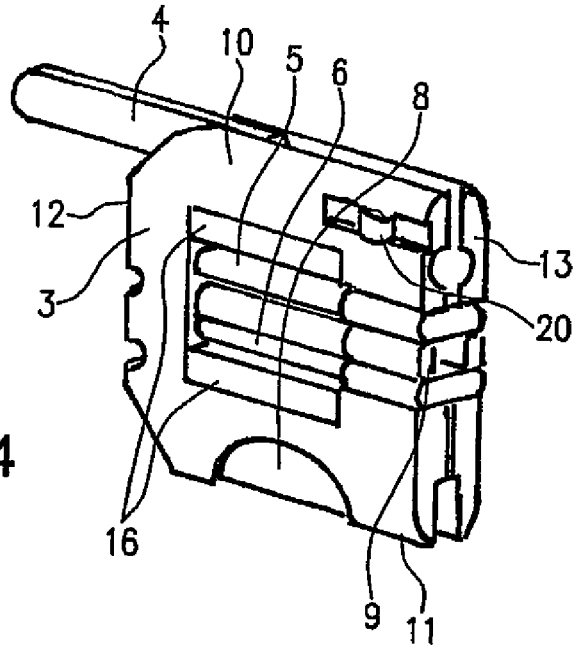
FIG. 4 shows a ground pin holder 3 being inserted in the first hollow shell of FIGS. 2 and 3.

FIG. 4 shows a ground pin holder 3 being located in operation in the insulating room 104 of the first hollow shell 1 of FIG. 3. The ground pin holder 3 can be pulled out of the insulating room 104 when a plug should be performed. On the ground pin holder 3 pins 4, 5, 6, 7, 8 are assembled which equip the requested plug. The pins 4, 5, 6, 8 shown in FIG. 4 are in their rest position located along suitable slots in the ground pin holder 3.

Figure 5:
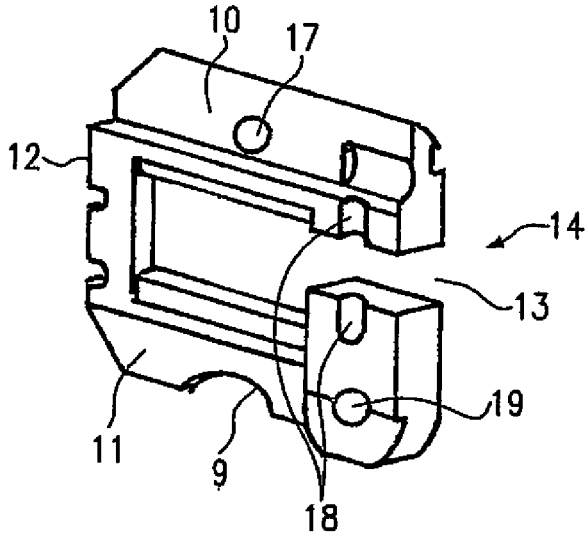
FIG. 5 shows a first part of the ground pin holder shown in FIG. 4.
Figure 6:
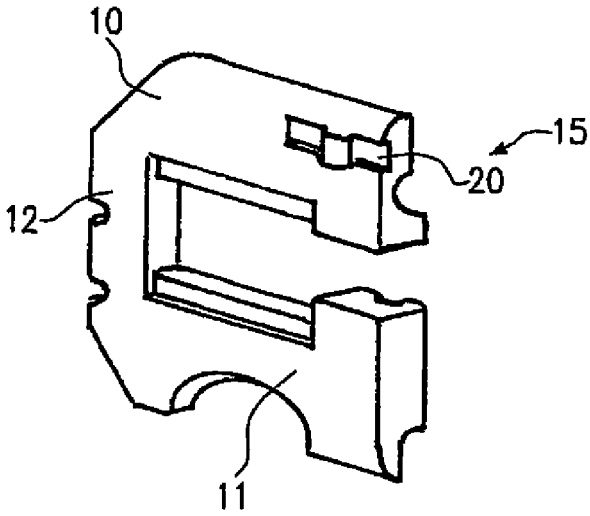
FIG. 6 shows a second part of the ground pin holder shown in FIG. 4.
Figure 7:
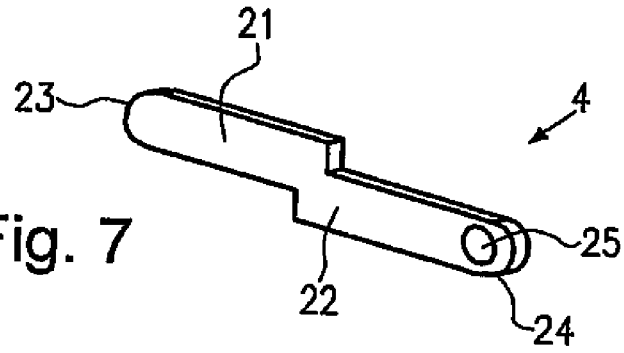
FIGS. 7 to 11 show different kinds of ground pins used in the ground pin holder of FIG. 4.

FIGS. 5 and 6 show a first metal cheek 14 and a second metal cheek 15, respectively, of the U-formed ground pin holder 3 of FIG. 4. The two metal cheeks 14, 15 are locked and pressed together by two springy fasteners 16 keeping the ground pins 4, 5, 6, 7, 8 between the metal cheeks in suitable slots and housings of inner side walls of the metal cheeks in their rest position and allow the removal turning and pivoting of the ground pins to their operative position.

A first U-beam 10 of the ground pin holder 3 comprises about in its middle part of its inner side wall a hemispherical socket 17. The first U-beam further comprises ground splines 20 on its outer side walls near the front side 13 of the ground pin holder 3. A second U-beam 11 of the ground pin holder 3 comprises a finger tip-formed recess 9. The second U-beam further comprises a pair of hemispherical sockets 19 being provided opposite to each other on the inner side walls of the two metal cheeks 14, 15 near the front side 13 of the ground pin holder 3. Near the open front side 13, the U-beams 10, 11, comprise cylindrical recesses forming a shaft housing 18, as well as a socket of French standard [F] 18 a.

FIGS. 7 to 11 show different kinds of round pins 4 to 8 used in the ground pin holder 3 of FIG. 4.

A first ground pin 4 is knifelike shaped. A knife edge like part 21 of the first ground pin 4 is out of line to a knife handle like part 22 and the longitudinal axis of the first ground pin 4. The first ground pin 4 further comprises a mounting end 24 having a bore hole 25. The first ground pin 4 is hinged on the ground pin holder 3 by a ball-and-socket joint wherein a ball is inserted between the bore hole 25 and the socket 17 of the first metal cheek 14 of the ground pin holder 3. Therefore, it can pivot 180° around the ball perpendicular to a parallel axis of the first U-beam of the ground pin holder 3, assuming the position suitable for standards [C], [P], [X] and [T].

Figure 8:
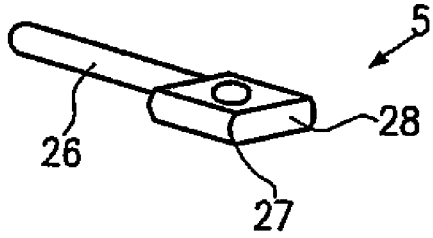
Figure 9:
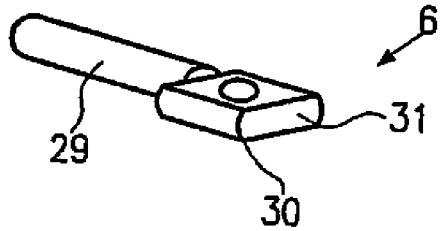

FIGS. 8 and 9 show a second ground pin 5 and a third ground pin 6, respectively, suitable for the standards [I], [J], [K] and [M]. The pins have rod-shaped projections 26, 29 and prismatic mounting ends 27, 30 with bore holes 28, 31.

Figure 10:
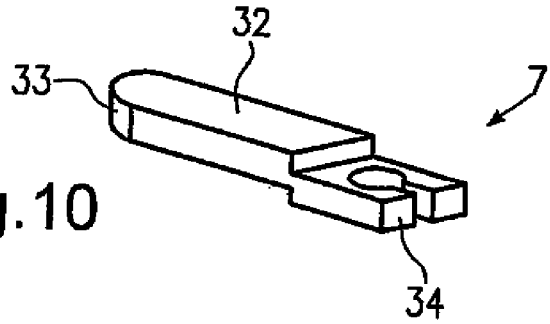

FIG. 10 shows an extractable prismatic fourth ground pin 7 suitable for new Indian standard [Bs 546]. The fourth ground pin can be inserted between the two prismatic heads 16 of the ground pin holder 3. It comprises a thick U-shaped plate with a rounded edge and a mounting end. The mounting end has two springy arms 34 to pinch the fourth ground pin 7 on a micro-shaft 39 which is described with reference to FIG. 12. The springy arms 34 allow pivoting of the fourth ground pin around the micro-shaft 39 until to reach its rest position between the second ground pin 5 and the third ground pin 6. The fourth ground pin 7, when requested, must be pulled away from the micro-shaft 39 and inserted by the two springy arms 34 in the proper ground splines 20 onto the ground pin holder 3 taking the right ground operative position for the standard [Bs 546].

Figure 11:
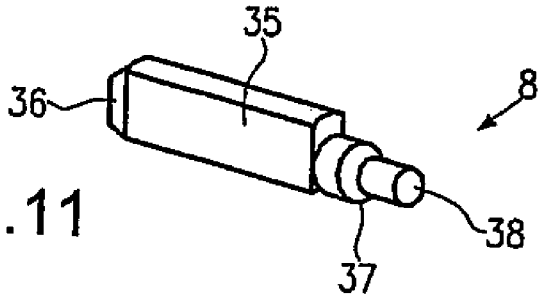

FIG. 11 shows a fifth ground pin 8 having the form of a thicker elongated plate 35 with a graded tip 36. The fourth ground pin comprises a mounting end 37 with a small spherical extension 38. The extension is located between the corresponding sockets 19 in the first and the second metal cheek 14, 15 of the ground pin holder 3. The fifth ground pin 8 can turn and pivot to all positions including turning around its own axis realising both [D] and [H] standards.

Figure 12:
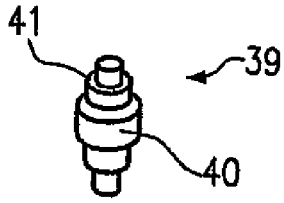
FIG. 12 shows a micro-shaft used in the ground pin holder of FIG. 4.

The ground pins 5, 6, 7 match with a microshaft 39 shown in FIG. 12 located in the shaft housing 18 in the middle of the ground pin holder 3. The shaft 38 has an upper drilled head that has fitted a small double nail head acting as a rotation axis and fastener for the pins. On the micro-shaft 39 two prismatic mounting ends of the pins 5 to 7 are mounted allowing their rotation perpendicular the axis of the shaft 39.

In a middle position 40 of the microshaft 9, the two rectangular mounting ends 30 and 27 of the second and the third ground pin 5, 6 are located in a small round room of the mounting end 27 of the second ground pin 5 one O-ring is fitted. When the mounting ends 27, 31 are faced to each other and fitted up unto the microshaft 39, the O-ring presses the mounting ends against the ground pin holder 3 and enables electrical contact between the ground pins 5, 6 and the ground pin holder 3.

Figure 13:
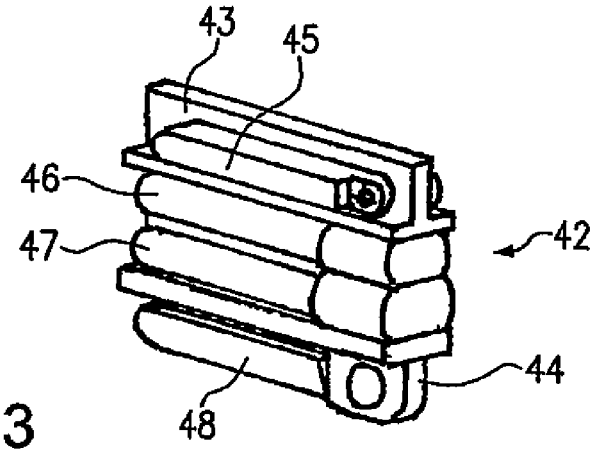
FIG. 13 shows a phase pin holder being inserted in the first hollow shell shown in FIGS. 2 and 3.
Figure 14:
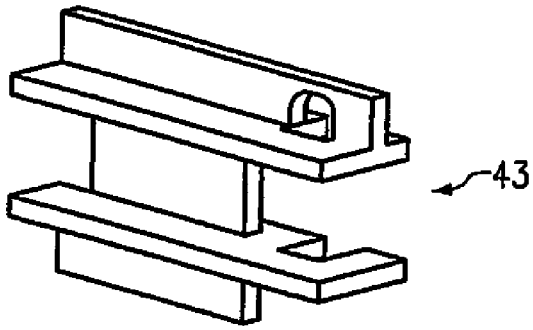
FIG. 14 shows a phase frame of the phase pin holder of FIG. 13.

FIG. 13 shows one phase pin holder 42, two of which are mirror-invertedly inserted in the insulating rooms 103, 105 of the first hollow shell 1. The phase pin holder 42 comprises a face frame 43 shown in FIG. 14, and a plurality of phase pins 45 to 50 being hinged on a drilled extension 44 shown in FIG. 15.

FIGS. 16 to 21 show different types of phase pins 45 to 50. The phase pins 45, 46, 47, 49, 50 comprise mounting ends 54, 57, 60, 66 and 69 with bore holes 65, 58, 61, 67, 70.

Figure 15:
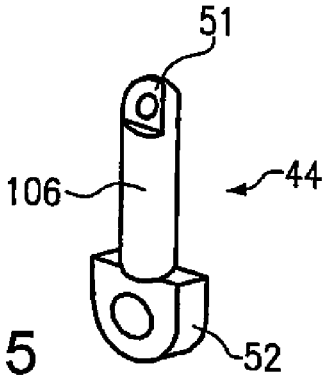
FIG. 15 shows a phase pin connecting member of the phase pin holder of FIG. 13.
Figure 16:
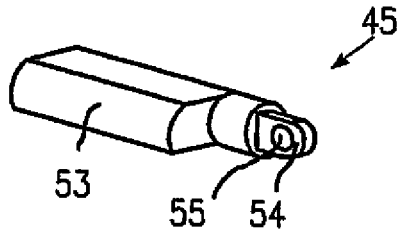
FIGS. 16–21 show phase pins used in the phase pin holder of FIG. 13.
Figure 17:
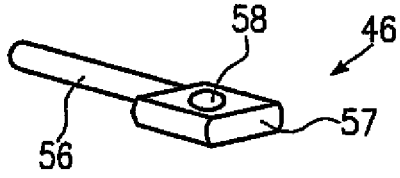
Figure 18:
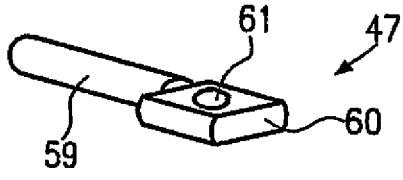
Figure 19:
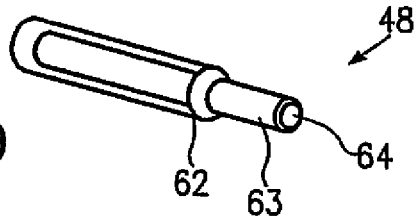
Figure 20:
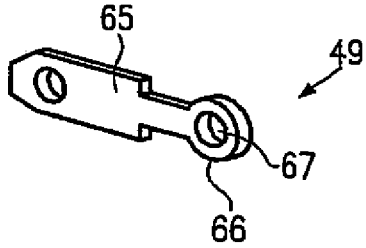
Figure 21:
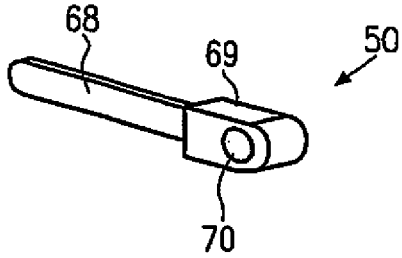

FIG. 15 shows a phase pin connecting member 44 with a shaft 106 and two mounting ends on each end of the shaft 106 with bore holes 51, 52. The shaft 106 extends through the bore holes 61, 58 of the phase pins 46, 47. One mounting end with the bore hole 52 is fitted up by a special articulated joint holding the phase pin 48 shown in FIG. 19 which is fitted up by means of a locking screw.

One side of the mounting end 60 of the phase pin 47 holds in a small round room 107 an O-ring. A nail extends through the bore hole 70 of the phase pin 50 shown in FIG. 21, and through a bore hole 52 of the connecting member 44 of FIG. 15 and through the articulated joint and is fastened with the locking screw. A further nail extends through the bore hole 67 of the phase pin 49 shown in FIG. 20, further through a hole 51 of the connecting member 44 and through the bore hole 55 of the phase pin 45 shown in FIG. 16 and is fastened with a further nail.

Figure 22:
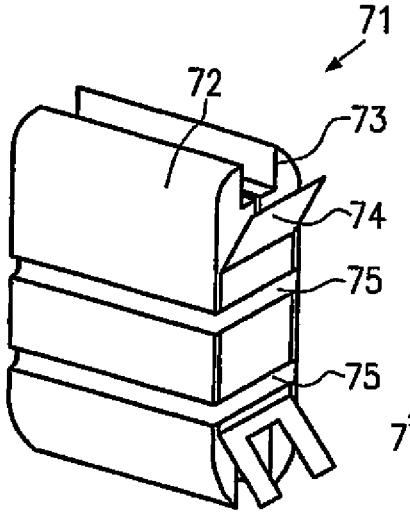
FIG. 22 shows a first pin insertion tool.
Figure 23:
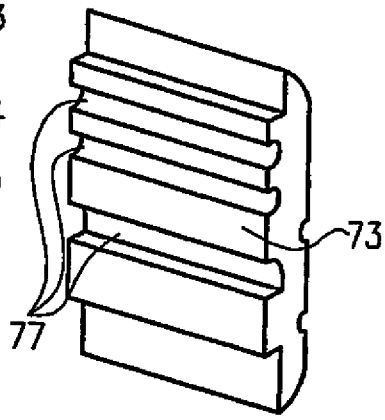
FIG. 23 shows a first metal cheek of the first pin insertion tool shown in FIG. 22.
Figure 24:
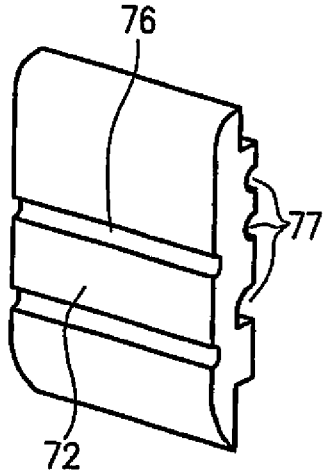
FIG. 24 shows a second metal cheek of the first pin insertion tool of FIG. 22.

FIG. 22 shows a first pin insertion tool 71 fitted up suitable to receive ground pins of different standards. The first pin insertion tool consists of two metal cheeks 72, 73, shown in FIG. 23 and FIG. 24, pressed together by means of staple springs 75 which enable an electrical contact between plugged pins and the adapter 100.

Figure 25:
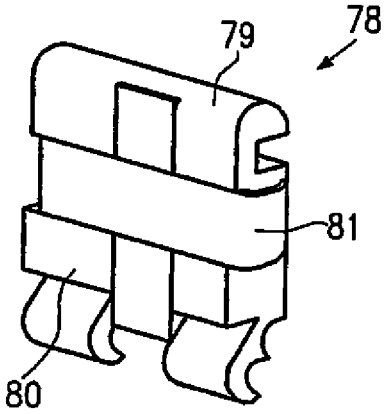
FIG. 25 shows a second pin insertion tool.
Figure 26:
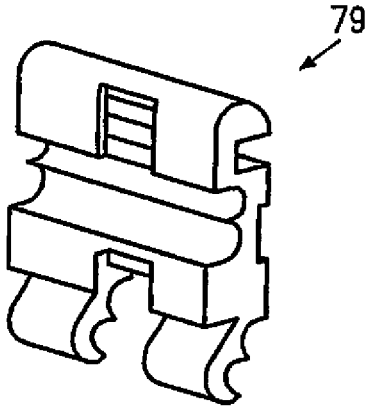
FIG. 26 shows a first metal cheek of the second pin insertion tool of FIG. 25.
Figure 27:
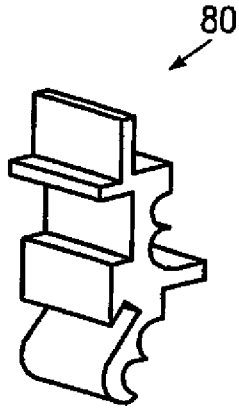
FIG. 27 shows a second metal cheek of the second pin insertion tool of FIG. 25.
Figure 28:
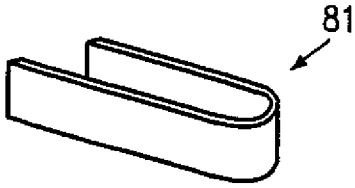
FIG. 28 shows a staple spring used in the second pin insertion tool of FIG. 25.
Figure 29:
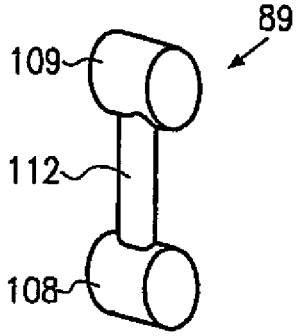
FIG. 29 shows a fuse being inserted between the second pin insertion tool shown in FIG. 25 and the phase pin holder shown in FIG. 13.
Figure 30:
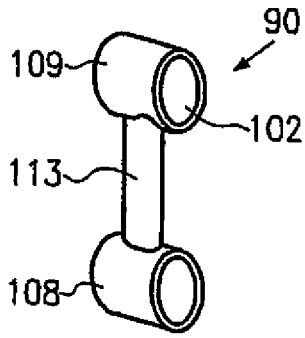
FIG. 30 shows a metal connection between another second pin insertion tool shown in FIG. 25 and between another phase pin holder shown in FIG. 13.

FIG. 25 shows one of two second pin insertion tools 78 sandwiching the first pin insertion tool 71. The second pin insertion tool consists of two metal cheeks 79, 80 shown in FIG. 26 and FIG. 27 pressed together by means of a staple spring 81 shown in FIG. 28.

The first and the second pin insertion tools 71, 78 give electrical continuity to the ground pin holder 3 and the phase pin holders 42 through a set of four round extractable boxes 108, 109 and a flat blade spring 74. The fourth small extractable round boxes 108, 109 are located in rooms 110 of the second hollow shell 91 shown in FIG. 31. When plug is assembled, the four small extractable round boxes 108, 109, are pressed between the face frame 43 and the face frame 111.

Each round box 108, 109 consists of two cheeks, one conductive and another one insulating, squeezing tips of one metal bar 113 and the tips of a fuse 112. The boxes 108, 109, if properly oriented enable current flow through the fuse 112 and the metal bar 113.

Grounding continuity is assured through a flat spring 74 kept against the first pin insertion tool 71 by two staple springs 75. When plug is assembled, springy edges of the flat spring 74 get in touch with the first pin insertion tool 71 with ground pin holder 3.

Figure 31:
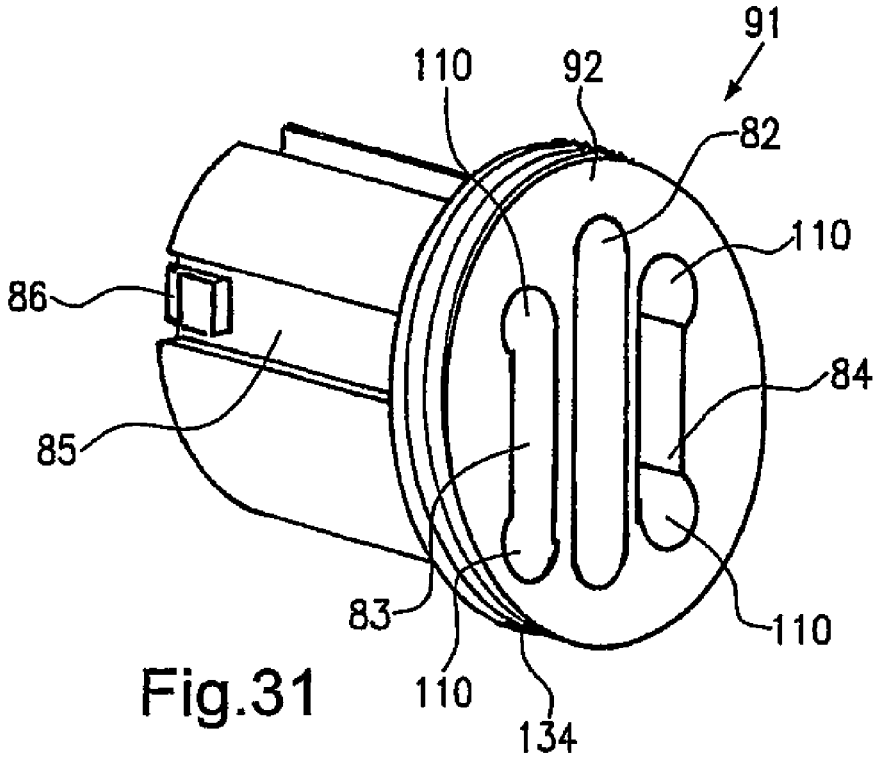
FIG. 31 is a perspective view of a second hollow shell of the adapter shown in FIG. 1 showing a back side of the second hollow shell.
Figure 32:
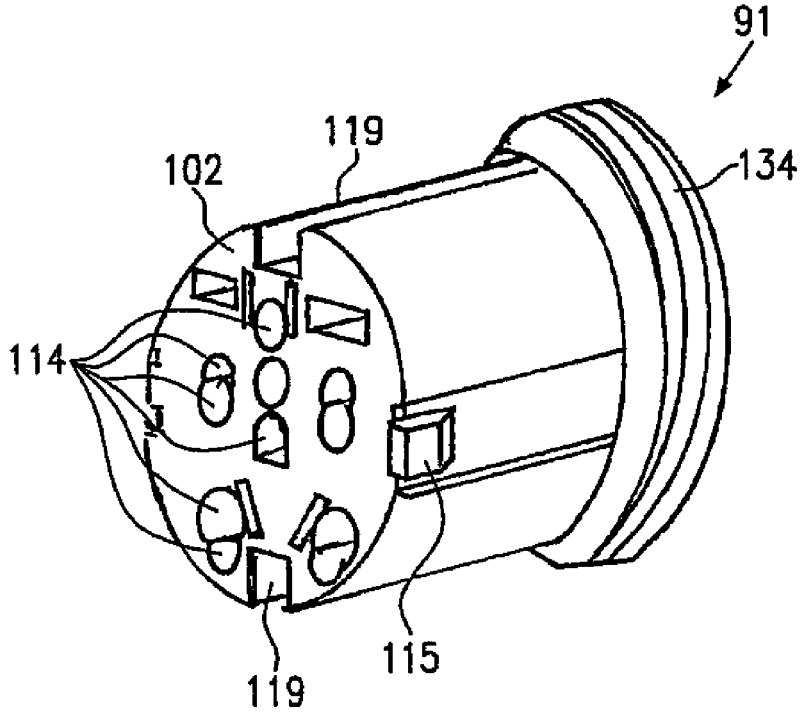
FIG. 32 is a perspective view of the second hollow shell of FIG. 31 showing a front side of the second hollow shell.

FIGS. 31 and 32 show the second hollow shell 91 ending on one side, with a face panel 102 provided with a set of shaped insertion holes 114 able to receive different plugs accepted by the adapter 100 two prongs 115 intergrow with this panel protrude out the face of the second hollow shell 91. On the opposite side 92, the second hollow shell 91 ends with a threaded crown 84 which matches with the lock nut 98. On the back side 92, the second hollow shell 91 comprises 3 openings to insulating rooms 82, 83, 84 where the first pin insertion tool 71 and the second pin insertion tools 78 are fitted up suitable to receive phase and ground pins of different standards. Further, two prongs 86 integral with the face panel 102 protrude out of the face panel 102 of the second hollow shell 91.

Figure 33:
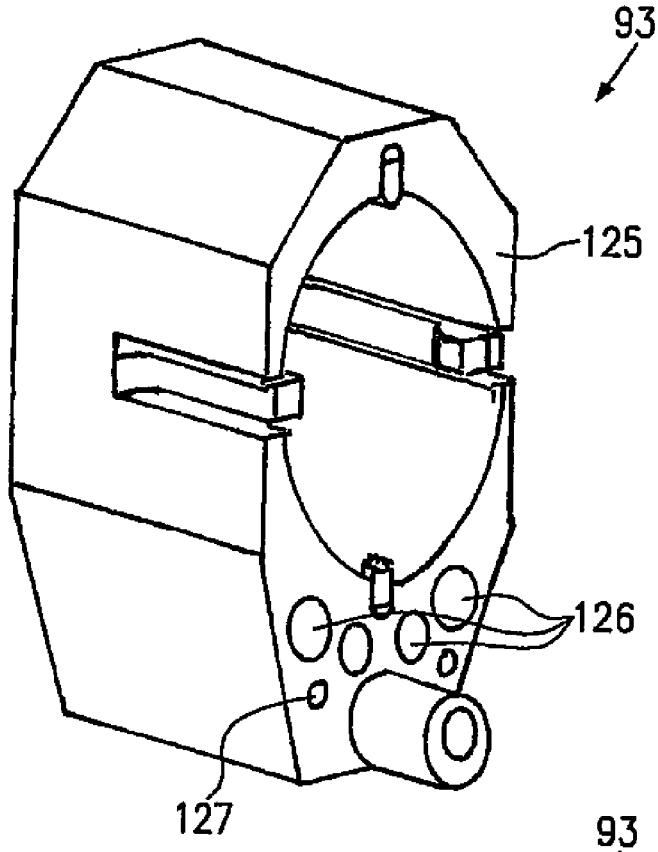
FIG. 33 shows a plug guide of the adapter shown in FIG. 1 with a view of the back side of the plug guide.
Figure 34:
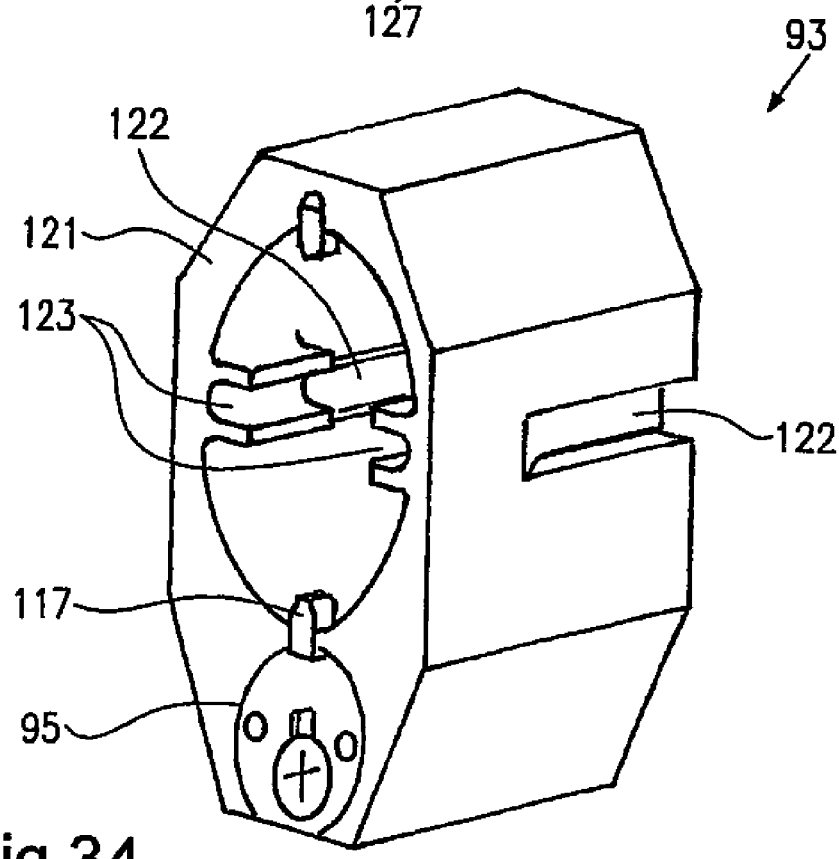
FIG. 34 shows the plug guide of FIG. 33 with a view of the front side of the plug guide.
Figure 35:
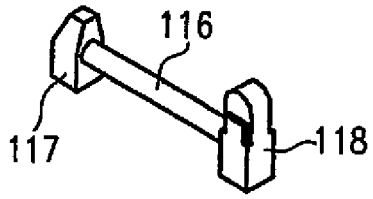
FIG. 35 shows a conductive bar placed between the plug guide shown in FIGS. 33 and 34 and the second hollow shell shown in FIGS. 31 and 32.

FIGS. 33 and 34 show a backside and a frontside of the plug guide 93, respectively. On an inner surface of the plug guide 93, two metal conductive bars 116, shown in FIG. 35, are assembled ending on one side with the contact heads 117 and on the other side with scraping prongs 118. Doing a backing stroke of the plug guide, the scraping prongs 118 move into two opened slots 119 of the second hollow shell 91 scraping along upper recessed edges 120 of the first pin insertion tool 71 pressed together by the staple springs 75 while the contact head 117 scrapes along ground strips allowing electrical contact between the adapter 100 and a plug.

Integral with a frontside 121 of the plug guide opposite to tongues 122, there are two shaped slots 123 acting as guide for the insertion of a plug.

Figure 36:
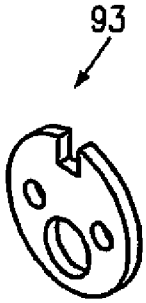
FIG. 36 shows a plastic cover of the plug guide shown in FIG. 34.
Figure 37:
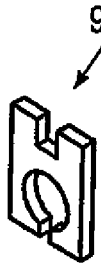
FIG. 37 shows a flat plate used in the plug guide shown in FIG. 34.
Figure 38:
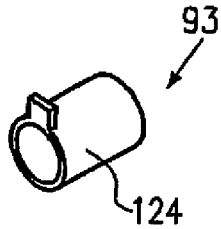
FIG. 38 shows a conductive pipe used in the plug guide shown in FIG. 34.

On a lower part of the frontside 121 of the plug guide 93 are plastic cover 95 shown in FIG. 36 is fitted up and is duly drilled to receive a ground pin of a plug. The backside of a plastic cover 95 contains in a proper room a conductive flat plate 96 shown in FIG. 37, ending in its upper part, with a slot inserted onto the lower contact head 117. The lower part of the flat plate 96 is drilled to enable an insertion of ground pins of a plug.

The flat plate 96 when the plastic cover 95 is fitted to the plug guide 93 pushes against a contact pipe 97 located into a proper guide of pin hole or plug. The contact pipe 97 ends with a scraping blade 124 integral with the pipe and protruding inside the pipe room. Clearance between the scraping blade 124 and the hole size should not allow insertion of ground pins of other plug but forcing them inside the holes, the scraping blade 124 bends itself and enables to plug the pins giving ground continuity through the contact pipe 97, the flat plate 96, the contact heads 117, the flat spring 74 and the ground pin holder 3.

The backside 125 of the plug guide 93 contains 4 blind chambers 126 acting as storerooms for another set of extractable boxes 108 and 109 suitable for the European standard and fuses as well. Proper round corks 127 plug each blind chamber 126.

To fit the plug guide 93 onto the second hollow shell 91, prongs 128 of the plug guide 93 are put onto prongs 115. Then the plug guide 93 is pressed against the second hollow shell 91 until the prongs 115 push out aside the prongs 128 bending springy tongues 122 getting over the prongs 115 of the second hollow shell 91. Now, the plug guide 93 can slide onto the second hollow shell 91 ending the stroke against the threaded crown 134.

Figure 39:
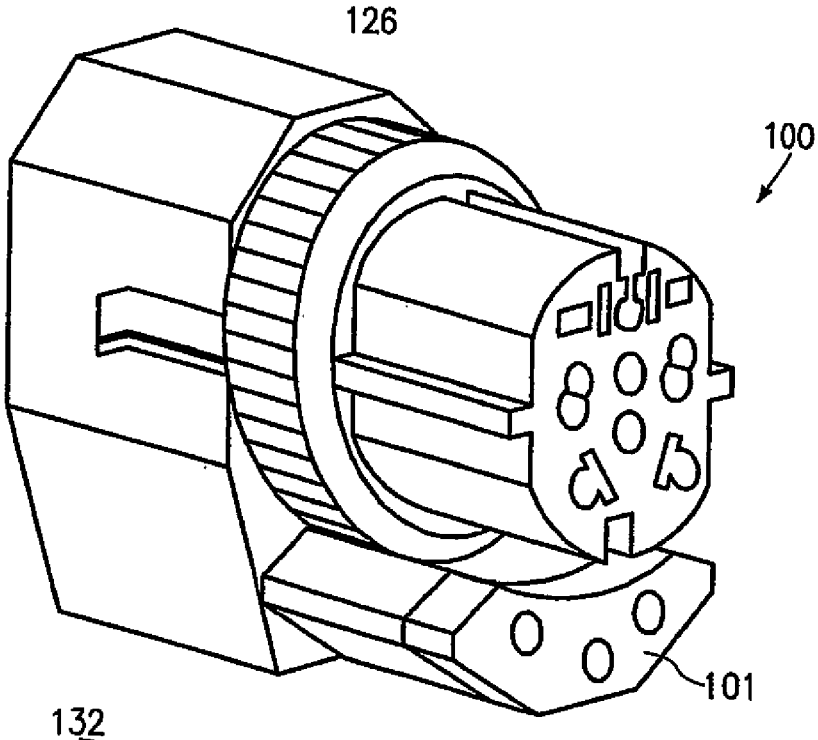
FIG. 39 shows a further embodiment of the adapter of the present invention, the adapter having an additional adapter unit.
Figure 40:
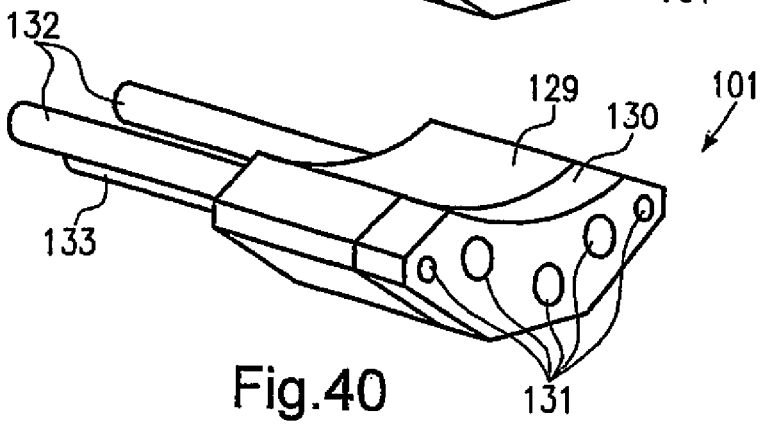
FIG. 40 shows the additional adapter unit of FIG. 39.

FIG. 39 shows a further embodiment of an adapter of the present invention wherein the adapter 100 shown in FIG. 1 has an additional adapter unit 101. The adapter of FIG. 39 supports all electrical plug standards except for Israel [H] and for the Russian Republic [O], respectively. The additional adapter unit 101 is shown in FIG. 40. It can be plugged directly in the Swiss standard [L]. It comprises a plastic body 129 with a suitable cover 130. In the plastic body 129 there are three rooms where round metal contact frames are fitted up.

Two frames in the front part of the plastic body 129 protrude with two phase pins 132 for standards [A] and [F], respectively. A third metal contact frame similar to the above mentioned ends with a ground pin 133 for the standard [I] that protrudes as well from the plastic body 129.

Back to FIG. 39, the pins are received in respective openings in the back face panel 125 of the plug guide 93 to perform the Swiss standard. The backside of the additional adapter unit 101, 130 (in FIG. 40) can receive phase pins of different standards through holes 131 of the cover 1.

The invention claimed is:

1. An electrical socket adapter (100) for selectively providing electrical pins and insertion holes in different configurations, the adapter comprising:

a casing with openings (2) in a front side (87) of the casing and at least one pin holder (3) being removably placed in the casing, wherein the pin holder comprises electrical pins being extendable through corresponding openings in the casing to protrude from the casing, characterized in that at least one electrical pin being hinged on the pin holder (3) to be selectively extractable from the pin holder, wherein in an operative position, the electrical pin protrudes from a front side (13) the pin holder, and in a rest position, the electrical pin is at least partially retracted in the pin holder.

2. The adapter of claim 1, wherein at least one electrical pin is hinged by a ball-and-socket joint.

3. The adapter of claim 2, wherein the electrical pin has a mounting end (94) with a bore hole (25) engaging with a ball being provided between the bore hole and a hemispheric socket (17) of the pin holder (3) to allow a pivotal movement of the electrical pin from at least the rest position to the operative position and vice versa.

4. The adapter of claim 2, wherein the electrical pin has a spherical mounting end (38) engaging with a hemispherical socket (19) of the pin holder (3) to allow a pivotal movement of the electrical pin at least from the rest position to the operative position and vice versa and/or to allow rotating movement of the electrical pin around an axis parallel to its longitudinal axis.

5. The adapter of claim 1, wherein the at least one electrical pin is hinged an a shaft (39) to allow a pivotal movement of the electrical pin perpendicular to a longitudinal axis of the shaft.

6. The adapter of claim 1, wherein the electrical pin has a mounting end (27, 30) with a bore hole (28, 31) through which the shaft (39) is extended.

7. The adapter of claim 6, wherein the electrical pin has a mounting end with a springy arm (34) provided to clutch the shaft (39) in the rest position of the electrical pin and to clutch a spline at the front side (13) of the pin holder (3).

8. The adapter of claim 1 wherein the at least one pin holder (3) comprises at least one ground pin holder (3) and at least one phase pin holder (42).

9. The adapter of claim 8, wherein one ground pin holder (3) is sandwiched by two phase pin holders (42), and wherein the ground pin holder is electrically insulated from the phase pin holders.

10. The adapter of claim 8 wherein the ground pin holder (3) has a plurality of ground pins (4, 5, 6, 7, 8) and/or the phase pin holder (42) has a plurality of phase pins (45, 46, 47,48, 49, 60).

11. The adapter of claim 1 wherein the adapter further comprises a pin insertion tool (71, 78) comprising at least two metal cheeks (72, 73; 79, 80) with corresponding opposite recesses wherein the metal cheeks are connected by at least one spring (75, 81) bringing the corresponding recesses together forming pin insertion holes (114).

12. The adapter of claim 1 wherein the casing comprises a first hollow shell (1) and a second hollow shell (91), each being of an insulating material wherein the first hollow shell being formed to house the at least one pin holder (3) and the second hollow shell being formed to house at least one pin insertion tool (71, 78) and wherein the shells are provided to be assembled such that an electrical connection between the pin holder and the pin insertion tool is formed, and to be disassembled such that the electrical connection is disconnected.

13. The adapter of claim 1 wherein a fuse (112) is placed between the at least one pin holder (3) and at least one pin insertion tool (71, 78) when an electrical connection between the pin holders and the pin insertion tool is formed.

14. The adapter of claim 1 wherein the casing comprises a plug guide (93) being slideable on a second hollow shell (91) formed to house at least one pin insertion tool (71, 78) to provide reciprocating movement of the plug guide relative to the second hollow shell along a longitudinal axis of the second hollow shell.

* * * * *